US006062892A

United States Patent [19]

Meng et al.

[11] Patent Number: 6,062,892

[45] Date of Patent: May 16, 2000

[54] ELECTRICAL CONNECTOR DEVICE

[75] Inventors: Ching-Chang Meng, Taipei; Jar-Bin Ding, Tu-Chen, both of Taiwan

[73] Assignee: Hon Hai Precision Ind. Co., Ltd., Taipei Hsien, Taiwan

[21] Appl. No.: 09/347,365

[22] Filed: Jul. 6, 1999

[30] Foreign Application Priority Data

Sep. 4, 1998 [TW] Taiwan ..... 87214663

[51] Int. Cl.[7] ..... H01R 13/627

[52] U.S. Cl. ..... 439/357; 439/660; 439/79

[58] Field of Search ..... 439/357, 660, 439/79

[56] References Cited

U.S. PATENT DOCUMENTS 5,267,881 12/1993 Matuzaki ..... 439/660
5,338,219 8/1994 Hiramoto et al. ..... 439/357
5,454,734 10/1995 Eggert et al. ..... 439/660
5,641,308 6/1997 Bixler et al. ..... 439/660
5,667,393 9/1997 Grabbe et al. ..... 439/660

*Primary Examiner*—Gary F. Paumen
*Attorney, Agent, or Firm*—Wei Te Chung

[57] ABSTRACT

An electrical connection device includes a socket connector and at least one plug connector. The socket connector is mounted to a substrate and defines two or more receptacle chambers each selectively mating with a plug connector. Each receptacle chamber has a tongue plate with a plurality of terminals fixed thereon. A resilient arm having a projection at a free end thereof is formed in the receptacle chamber for engaging with a raised section of the corresponding plug connector thereby retaining the plug connector in the receptacle chamber. The plug connector defines a slot for receiving the tongue plate. A plurality of contacts is arranged in the slot for electrically engaging with the terminals fixed to the tongue plate of the corresponding receptacle chamber.

4 Claims, 3 Drawing Sheets

ELECTRICAL CONNECTOR DEVICE

BACKGROUND OF THE INVENTION

1. Field of the Invention

The present invention generally relates to an electrical connection device comprising a socket connector and more than one mating plug connector, and in particular to an electrical connection device which can withstand repeated engagements/disengagements between a plug connector and a socket connector.

2. The Prior Art

Electrical connection devices comprising a socket connector and a mating plug connector are widely used. Retaining the plug connector in the socket connector is usually achieved by means of engagement between dimples and embossments formed on metal members thereof. Abrasion occurs when engaging the embossments with the dimples which leads to wearing and stripping of a surface layer of material thereby possibly leading to oxidation of the metal plate.

In addition, a conventional socket connector comprises a single receptacle chamber for receiving a single plug connector therein. Thus, each socket connector must be separately connected to a plug connector or mounted to a substrate thereby increasing assembly time.

It is thus desirable to have an electrical connection device that overcomes the problems of the prior art.

SUMMARY OF THE INVENTION

Accordingly, an object of the present invention is to provide an electrical connection device that can be efficiently mounted to a circuit board.

Another object of the present invention is to provide an electrical connection device comprising a socket connector having two or more receptacle chambers each mating with a plug connector thereby eliminating the need for mounting two or more socket connectors to a circuit board.

A further object of the present invention is to provide an electrical connection device that can withstand repeated engagements/disengagements with a mating connector.

To achieve the above objects, an electrical connection device in accordance with the present invention comprises a socket connector and at least one plug connector. The socket connector is mounted to a substrate and defines two or more receptacle chambers each selectively mating with a plug connector. Each receptacle chamber has a tongue plate with a plurality of terminals fixed thereon. A resilient arm having a projection at a free end thereof is formed in the receptacle chamber for engaging with a raised section of the corresponding plug connector thereby retaining the plug connector in the receptacle chamber. The plug connector defines a slot for receiving the tongue plate. A plurality of contacts is arranged in the slot for electrically engaging with the terminals fixed to the tongue plate of the corresponding receptacle chamber.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
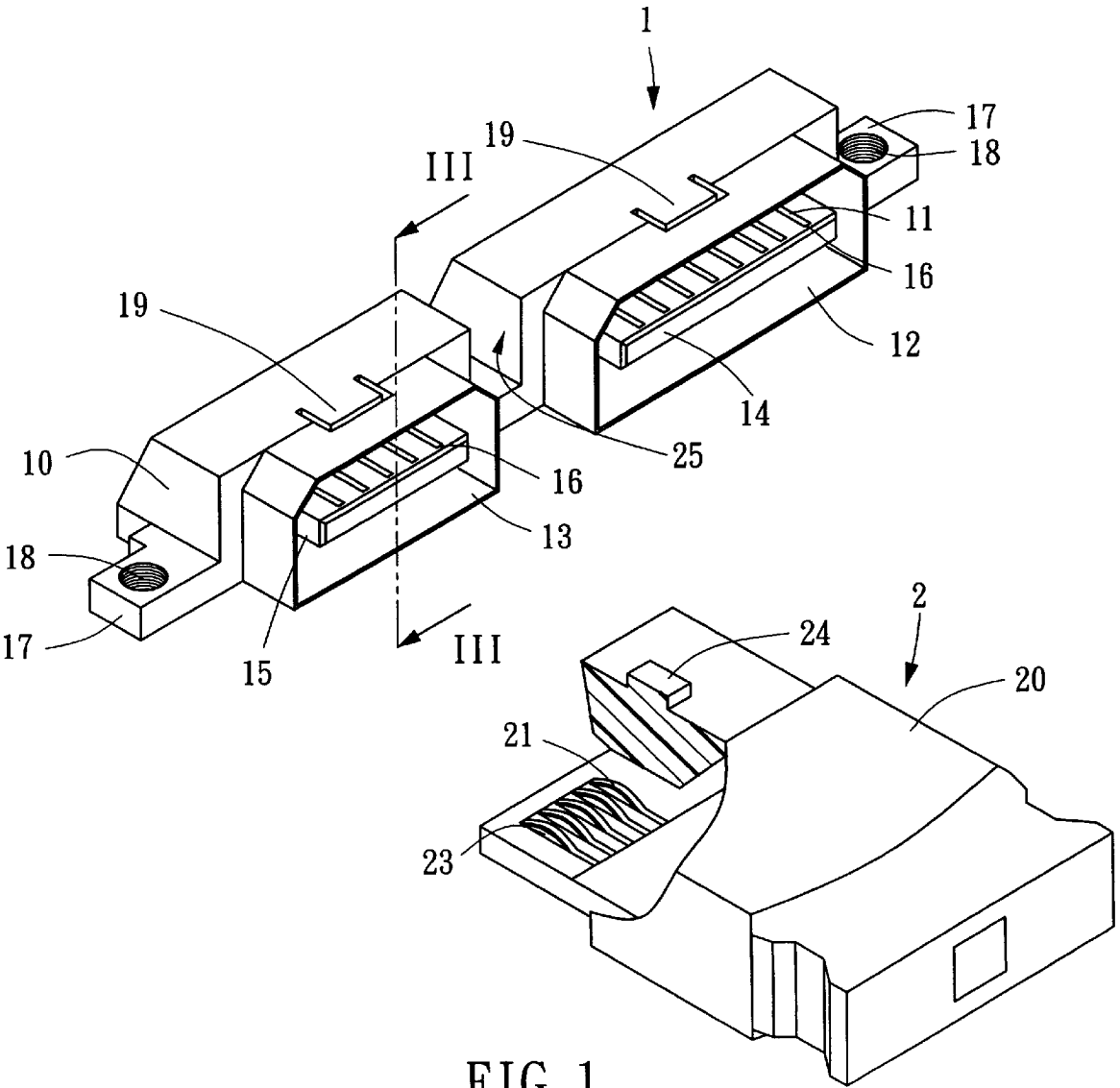
FIG. 1 is a perspective view of an electrical connection device constructed in accordance with the present invention, comprising a socket connector and at least one mating plug connector detached therefrom.

Referring to the drawings and in particular to FIG. 1, wherein an electrical connection device constructed in accordance with the present invention is shown, the electrical connection device comprises a socket connector 1 and at least one plug connector 2 releasably and electrically mated together.

Figure 2:
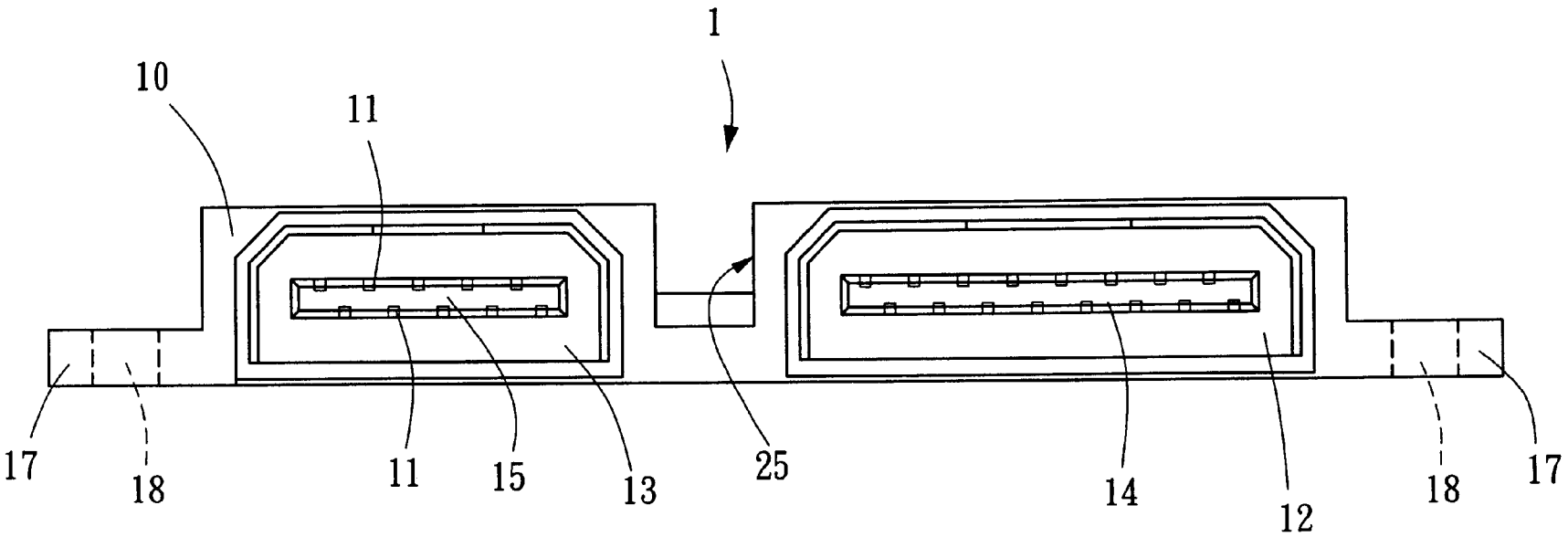
FIG. 2 is an end view of the receptacle connector of the electrical connection device of the present invention.

Also referring to FIG. 2, the socket connector 1 comprises a nonconductive casing 10 defining a first receptacle chamber 12 and a second receptacle chamber 13 therein. In the embodiment illustrated, the receptacle chambers 12, 13 are arranged side by side. Each receptacle chamber 12, 13 receives one plug connector 2 therein for mating the plug connector 2 with the socket connector 1.

Each receptacle chamber 12, 13 comprises a tongue plate 14, 15 having opposites surfaces on which a plurality of terminal receiving channels 16 are defined. Each terminal receiving channel 16 retains a conductive terminal 11 therein. In the embodiment illustrated, the number of terminals 11 arranged in the second receptacle chamber 13 is less than that of the first receptacle chamber 12.

Figure 3:
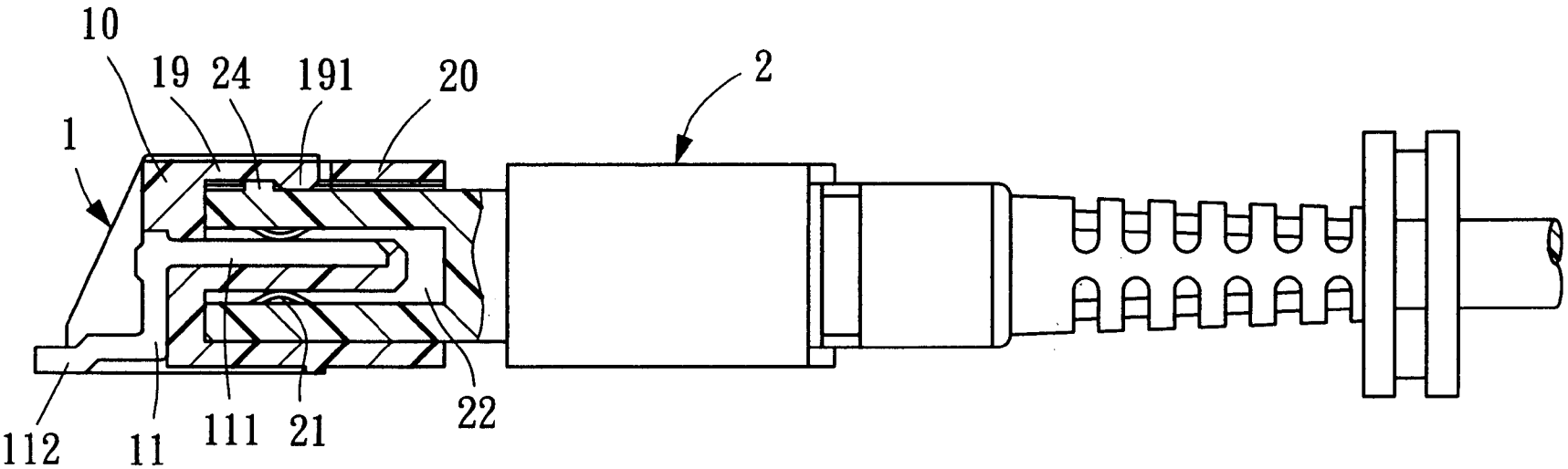
FIG. 3 is a cross-sectional view taken along line III—III of FIG. 1 with the plug connector received in the receptacle connector.

Also referring to FIG. 3, the casing 10 comprises a resilient cantilevered arm 19 corresponding to each receptacle chamber 12, 13. Each cantilevered arm 19 forms a projection 191 at a free end thereof projecting into the corresponding receptacle chamber 12, 13.

The casing 10 further comprises a pair of outward extensions 17 each forming a bolt hole 18 therein for extension of a bolt (not shown) therethrough. The bolt secures the casing 10 to a substrate (not shown), such as a circuit board. Preferably, the hole 18 is threaded for engaging with the bolt. Alternatively, the bolt may engage with a nut to secure the casing 10 to the substrate.

Each terminal 11 has a mating section 111 for engaging with a corresponding contact 23 of the plug connector 2 and a tail section 112 for being mounted to the substrate using surface mounting techniques. Thus, through holes are not required on the substrate thereby enhancing the mechanical strength thereof.

The plug connector 2 comprises a nonconductive casing 20 having a front portion sized to fit into the corresponding receptacle chamber 12, 13. A slot 22 is defined in a front face of the casing 20, for receiving the corresponding tongue plate 14, 15 therein. The slot 22 has two opposite inside faces, each defining contact receiving channels 21 for retaining the contacts 23 therein. The contacts 23 are arranged to electrically engage with the terminals 11 of the corresponding receptacle chamber 12, 13.

The plug connector 2 comprises a raised section 24 which is engageable by the projection 191 of the cantilevered arm 19 of the socket connector 1 for securely retaining the plug connector 2 in the corresponding receptacle chamber 12, 13.

The nonconductive casings 10, 20 of the socket connector 1 and the plug connector 2 are usually made of plastic. Since plastic generally exhibits a lower degree of hardness than metal which is usually used to make the terminals 16 and contacts 23, the projection 191 of the socket connector 1 and the raised section 24 of the plug connector 2 can effectively withstand repeated engagements/disengagements therebetween, thereby improving the durability of the connection device.

In the embodiment illustrated, the projection 191 and the raised section 24 are arranged on a top side of the connection device. However, if desired, the projection 191 and the raised section 24 may be formed on a lateral side of the receptacle chamber 12, 13 and the plug connector 2. Alternatively, more than one projection 191 and raised section 24 pair may be formed in each receptacle chamber 12, 13. For example, each receptacle chamber 12, 13 may have two cantilevered arms 19 each forming a projection 191. The two cantilevered arms 19 may be formed on outer sides of the receptacle chambers 12, 13.

If desired, the plug connector 2 and a second plug connector having a similar structure may be simultaneously fit into the receptacle chambers 12, 13 of the socket connector 1. It is understood that a cut-off 25 is formed in the casing 10 generally between two receptacle chambers 12, 13 so that the corresponding plug connector 2 and the second plug connector may be easily engaged with or disengaged from the casing 10 with proper operation and inspection.

Although the present invention has been described with reference to a preferred embodiment thereof, it is apparent to those skilled in the art that a variety of modifications and changes may be made without departing from the scope of the present invention which is intended to be defined by the appended claims.

What is claimed is:

1. An electrical connection device comprising:

a socket connector comprising a one-piece first nonconductive body defining two receptacle chambers with a cut-off therebetween, a plurality of terminals arranged in each receptacle chamber, at least one resilient arm formed in each receptacle chamber and forming a projection; and a plug connector comprising a second nonconductive body matingly receivable in one of the receptacle chambers of the socket connector, a plurality of contacts assembled in the second nonconductive housing and electrically engaging with the terminals of the socket connector, a raised section formed on the plug connector corresponding to each resilient arm, the raised section engaging with the projection of the corresponding resilient arm of the socket connector to retain the plug connector in the receptacle chamber;

wherein each receptacle chamber comprises a tongue plate disposed therein, the tongue plate having opposite surfaces on which the terminals are fixed.

2. The electrical connection device as claimed in claim 1, wherein the plug connector defines a slot for receiving the tongue plate of the socket connector, the contacts being arranged in the slot.

3. The electrical connection device as claimed in claim 1, wherein the socket connector comprises outward extensions each defining a bolt hole for extension of a bolt therethrough for fixing the socket connector to an external substrate.

4. An electrical connector comprising:

a one-piece non conductive casing defining a first receptacle chamber and a second receptacle chamber side by side arranged with each other, each of said receptacle chambers including a tongue plate with a plurality of terminals thereon, the casing defining a resilient cantilevered arm facing each tongue plate, and defining therein a cut-off between said two receptacle chambers, and a pair of outward extensions formed at opposite ends of the casing each with a bolt hole therein.

* * * * *